United States Patent [19]

Kamp et al.

[11] 4,283,908

[45] Aug. 18, 1981

[54] METHOD AND APPARATUS FOR PREPARING THE CHANGING OF COILS IN A RING SPINNING FRAME

[75] Inventors: Heinz Kamp, Wegberg; Joachim Rohner, Monchen-Gladbach, both of Fed. Rep. of Germany

[73] Assignee: W. Schlafhorst & Co., Monchen-Gladbach, Fed. Rep. of Germany

[21] Appl. No.: 7,021

[22] Filed: Jan. 29, 1979

[30] Foreign Application Priority Data

Jan. 30, 1978 [DE] Fed. Rep. of Germany ..... 2803930

[51] Int. Cl.[3] ..... D01H 9/00; D01H 9/08; D01H 9/10

[52] U.S. Cl. ..... 57/276; 57/268; 57/271

[58] Field of Search ..... 57/261, 264, 266, 268, 57/271, 276, 267, 269, 270

[56] References Cited

U.S. PATENT DOCUMENTS 4,138,839 2/1979 Stahlecker et al. ..... 57/270

*Primary Examiner*—Donald Watkins
*Attorney, Agent, or Firm*—Herbert L. Lerner

[57] ABSTRACT

Method and device for preparing a ring spinning frame for automatic coil changing, which includes controlling a movable automatic servicing device for the spinning operation and a movable automatic servicing device for changing coils with a central automatic spinning control which controls the spinning processes of all spinning units of the machine so that both mentioned servicing devices are placed in readiness at the machine end of the ring spinning frame when the spinning process is completed.

9 Claims, 6 Drawing Figures

METHOD AND APPARATUS FOR PREPARING THE CHANGING OF COILS IN A RING SPINNING FRAME

The invention relates to a method and apparatus for preparing the automatic changing of coils in a ring spinning frame which contains a central automatic spinning control for the spinning processes of all spinning units of the machine, a movable automatic servicing device for the spinning operation and a movable automatic servicing device for changing the coils.

In heretofore known devices a signal could be set only after the spinning operation at a ring spinning frame had first ceased, whereupon an operator would bring up the servicing device for changing the coils and initiate the coil changing process. With this procedure, there are waiting times which are quite unavoidable. These waiting times lower the efficiency of the ring spinning frame.

It is accordingly an object of the invention to provide a method and apparatus for preparing the changing of coils in a ring spinning machine which overcomes the above-mentioned shortcomings of the heretofore known devices of this general type and to improve the efficiency of the ring spinning frame.

With the foregoing and other objects in view there is provided, in accordance with the invention a method for preparing a ring spinning frame for automatic coil changing, which comprises controlling a movable automatic servicing device for the spinning operation and a movable automatic servicing device for changing coils with a central automatic spinning control which controls the spinning processes of all spinning units of the machine so that as far as possible both mentioned servicing devices are placed in readiness at the machine end of the ring spinning frame when the spinning process is completed. Therefore there is no longer any waiting for the ring spinning frame to stop. Instead travel commands are already given in advance by the automatic spinning control to the servicing devices so that they are in readiness at the time when the spinning process ceases and the changing of coils can start immediately. The spinning process ceases at the instant when the spinning coil is completely wound, the end of the thread is brought in helical turns to the base end of the coil and is optionally wound there to form base turns.

If two or more ring spinning frames are operated in parallel, either the servicing device for the spinning operation or the servicing device for changing coils can be assigned to two or more spinning frames. If the ring spinning frames are disposed in groups side by side as well as one behind the other, the servicing device for changing coils can be assigned to all ring spinning frames, and the servicing device for the spinning operation can be assigned jointly to the respective ring spinning frames which are mounted side by side.

In accordance with another mode of the invention, there is provided a method which includes interlocking the control of both servicing devices when two or more ring spinning frames are operated in parallel and only one servicing device services two or more spinning frames so that a coil change which is in preparation or in progress in any spinning frame operated in parallel is completed before the automatic spinning control can control the servicing of another ring spinning machine.

Further in accordance with the invention, there is provided an apparatus for carrying out a method of preparing a ring spinning frame of a spinning machine for automatic coil changing, comprising a movable automatic servicing device for the spinning operation, a movable automatic servicing device for changing coils, central automatic means for controlling spinning at all spinning units of the machine to place both mentioned servicing devices in readiness at an end of the machine when spinning is completed, and a propulsion drive connected to the servicing device for the spinning operation, the propulsion drive being controllable by the central automatic spinning control means. In this connection, there are different possible embodiments.

In accordance with a further feature of the invention, the propulsion drive commonly drives both of the servicing devices.

In accordance with an additional feature of the invention, the servicing device for changing coils is couplable to the servicing device for the spinning operation.

In accordance with still another feature of the invention, the servicing device for changing coils is couplable to the propulsion drive. During the coil change, the servicing device for the spinning operation serves in this case, so to speak, as a locomotive for the servicing device for changing coils.

If the servicing device for changing coils is to service several ring spinning frames, in accordance with yet another feature of the invention, there is provided a track disposed transverse to the ring spinning frame and above the spinning machine, the servicing device for changing coils being movable along the track from one ring spinning frame to another.

This transverse track leads, for instance, past the machine ends of ring spinning frames which stand one behind the other.

In case the servicing device for changing coils has no propulsion drive of its own, in accordance with concomitant feature of the invention there is provided a fixed other propulsion drive for moving the servicing device for changing coils along the track, the other propulsion drive being controllable by the central automatic control means of any spinning frame servicable by the servicing device for changing coils.

The automatic spinning control of the ring spinning frame must therefore have the capability of controlling the movable propulsion drive which drives the servicing devices in their travel along the ring spinning frame as well as the stationary other propulsion drive which takes care of the transverse travel of the servicing device for changing coils. This requires circuit arrangements, control lines, power supplies and interlocks of conventional types, which are well known in the art and therefore will not be discussed herein in detail.

Other features which are considered as characteristic for the invention are set forth in the appended claims.

Although the invention is illustrated and described herein as embodied in a method and apparatus for preparing the changing of coils in a ring spinning frame, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 4:
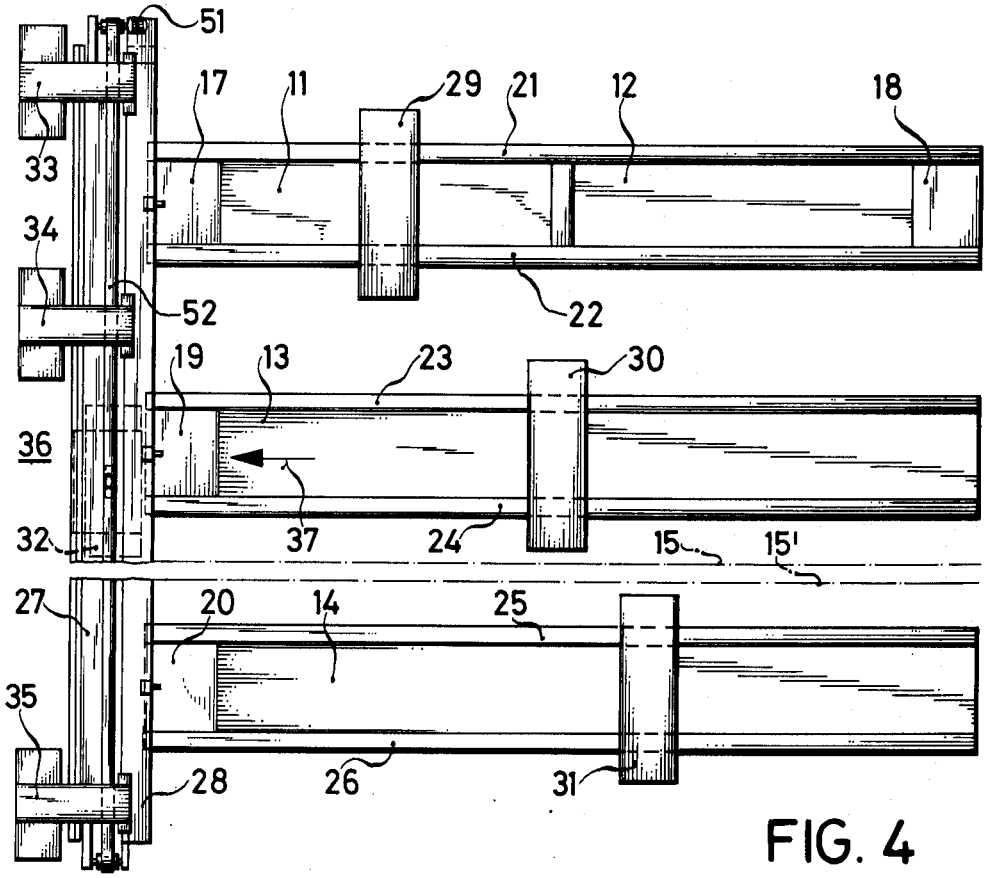
FIG. 4 is a diagrammatic top plan view of several ring spinning frames and the transverse track of the servicing device for changing coils.

Referring now to the figures of the drawing and first, particularly to FIG. 4 thereof, there are seen ring spinning frames 11 to 14. The ring spinning frame 12 stands next to the ring spinning frame 11. The ring spinning frame 13 stands behind the ring spinning frame 14 and the ring spinning frames 11 and 12 stand behind the ring spinning frame 13. Fracture lines 15, 15' are to indicate that if required, still further ring spinning frames can be disposed between the ring spinning frames 13 and 14. The common machine end 17, to the left in FIG. 4, contains the automatic spinning control of the ring spinning frame 11 and the common machine end 18, to the right in FIG. 4, contains the automatic spinning control of the ring spinning frame 12. The machine ends 19 and 20, respectively, of the ring spinning frames 13 and 14 containing the automatic spinning controls therefor are disposed at the left of the frames in FIG. 4.

Above the ring spinning frames 11 and 12 are seen rails 21, 22 on which a servicing device 29 for the spinning operation can be moved. This servicing device therefore services both ring spinning frames.

The ring spinning frames 13 and 14 each have a servicing device 30, 31 of their own for the spinning operation. The servicing device 30 can be moved on the rails 23, 24 and the servicing device 31 on the rails 25, 26.

On the left-hand side of FIG. 4 are seen stands 33, 34, 35 from which rails 27, 28 are suspended. These stands and rails form a transverse track, designated as a whole with reference numeral 36, for a servicing device 32 for changing coils.

Figure 5:
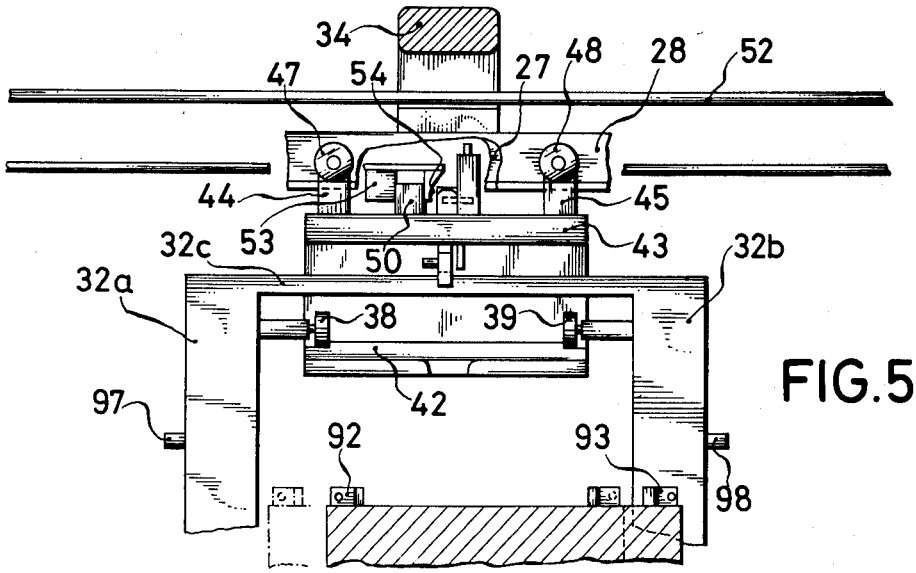
FIG. 5 is a detailed fractional side elevational view, partly broken away, of the running mechanism of the servicing device for changing coils taken in the direction of the arrow 37 in FIG. 4.

A partial view of the servicing device 32 taken in the direction of the arrow 37 is shown in FIG. 5. It can be seen in FIG. 5 that the servicing device 32 for changing coils includes the two parts 32*a* and 32*b* which are joined together by a cross piece 32*c* in the form of a portal. FIG. 5 also shows the stand 34 and the rails 27 and 28.

The servicing device 32 has casters 38, 39 of its own. Two further casters 40 and 41 located behind the casters 38 and 39 are not visible in FIG. 5. The casters 38 to 41 are supported on the track 42 of a suspension carriage 43. The suspension carriage 43 is suspended from beams 44 to 46, which carry rollers 47 to 49. These rollers are supported on the rails 27, 28 (see also FIG. 1).

A dog 50 serves for moving the suspension carriage 43 along. The movement is provided by an endless belt 52 which is driven by the motor 51 (FIG. 4) and is equipped with two legs 53, 54 which embrace the dog 50.

Figure 1:
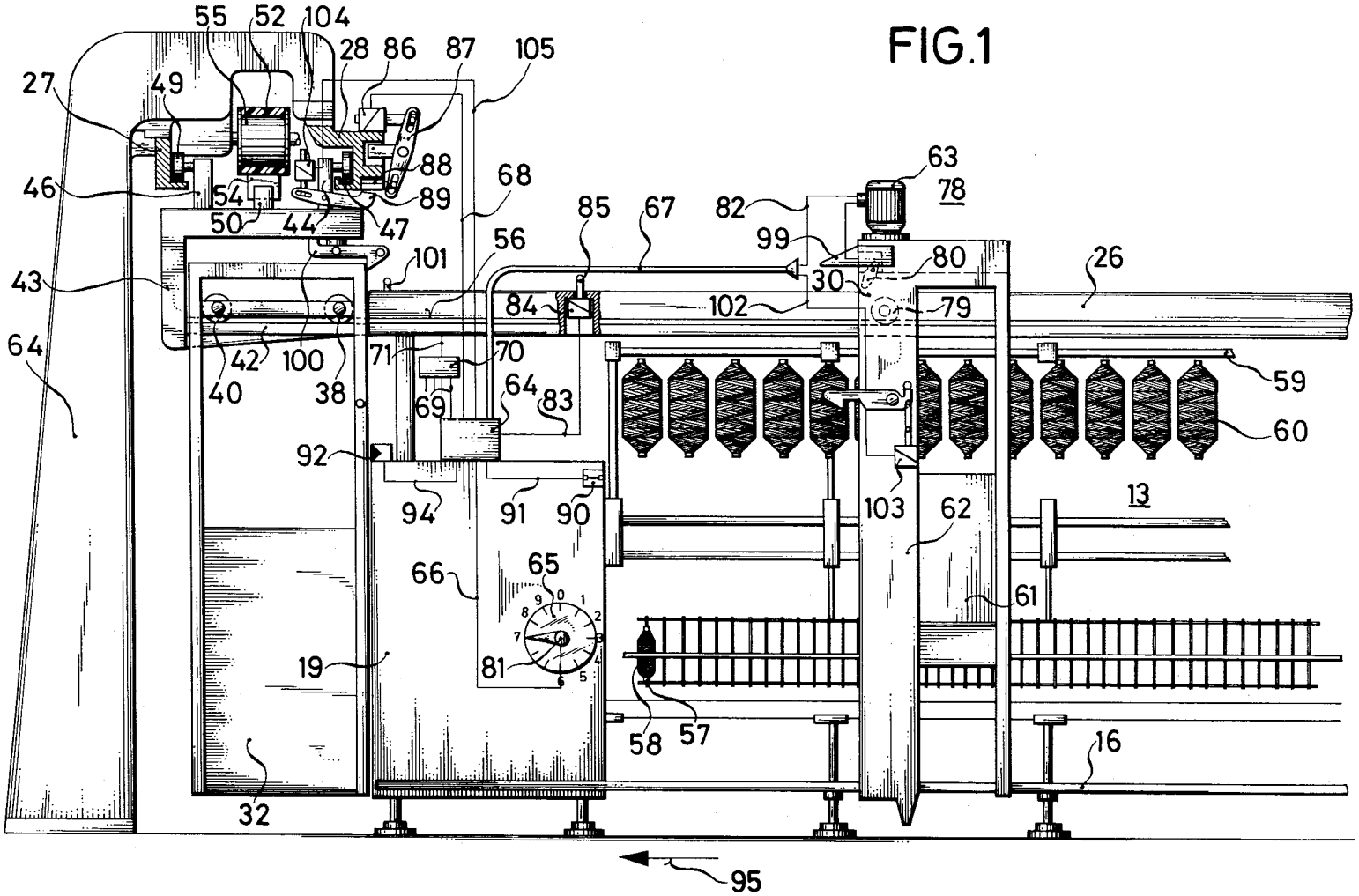
FIG. 1 is a diagrammatic front elevational view of a ring spinning frame in accordance with the invention shortly before the end of the spinning process.
Figure 2:
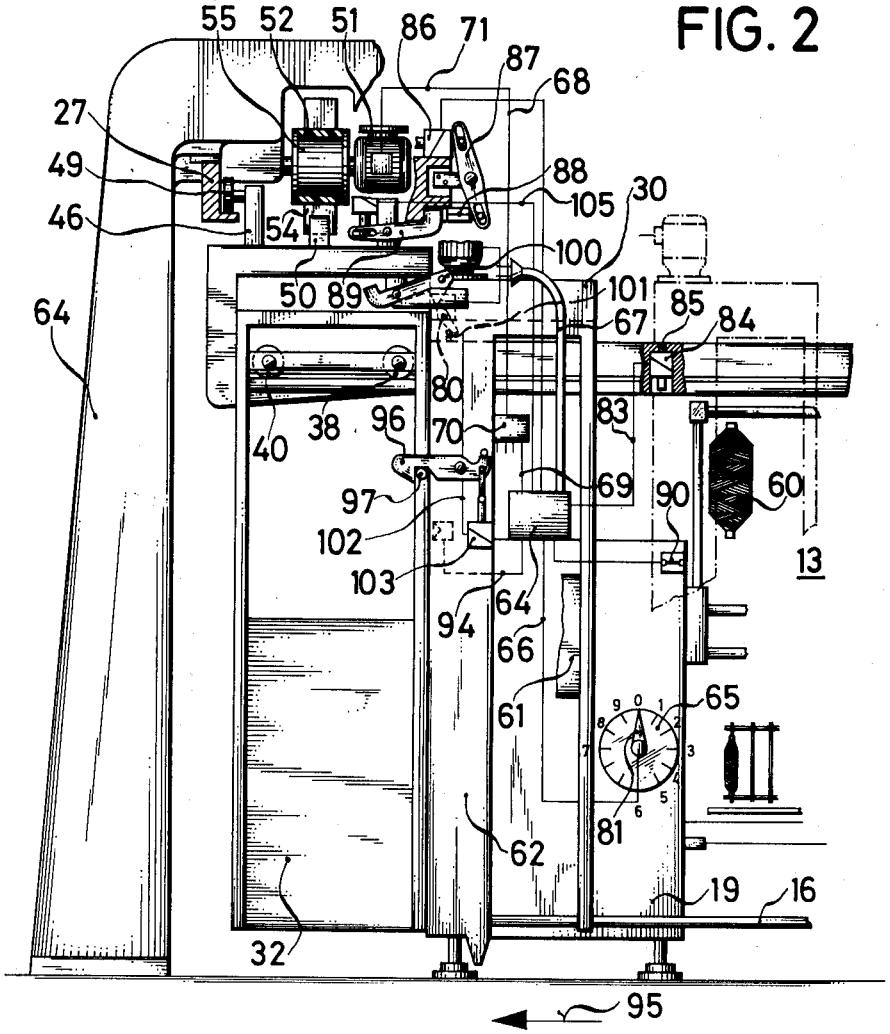
FIG. 2 is a view of part of the ring spinning frame of FIG. 1 at the moment when the spinning process is completed.
Figure 3:
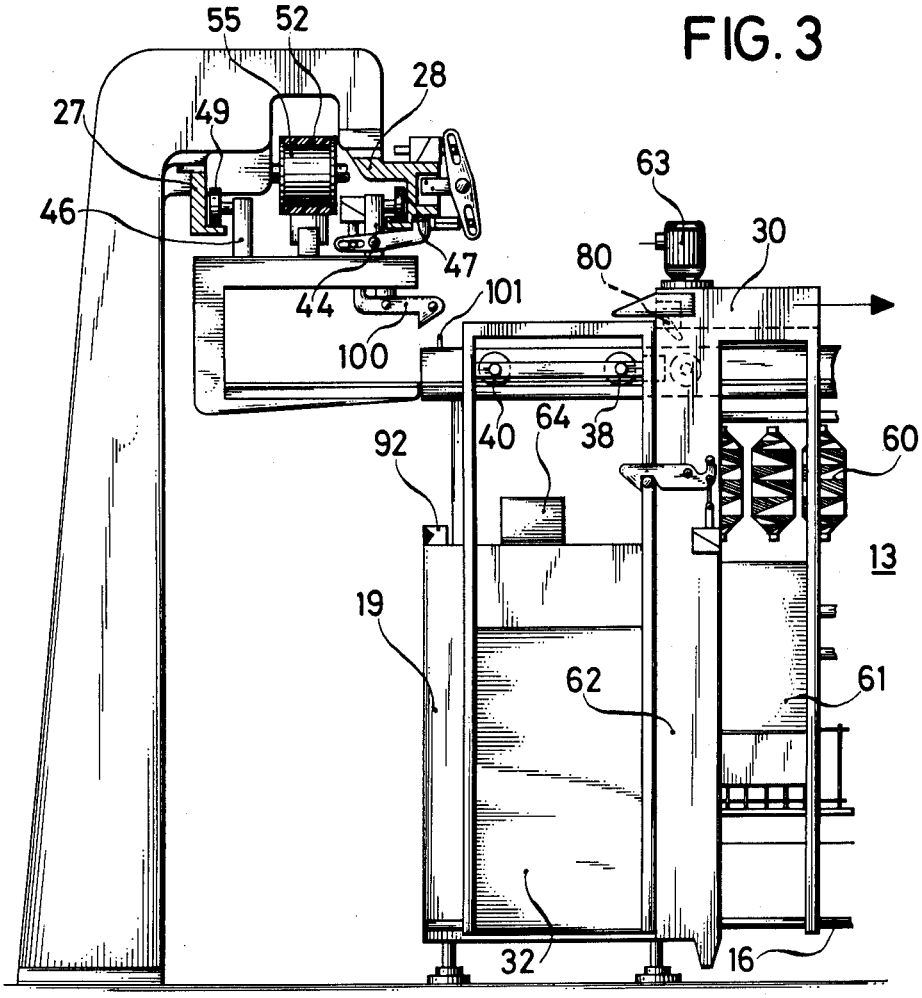
FIG. 3 is a view of the ring spinning frame of FIGS. 1 and 2 at the start of the coil change.

In the drawings, FIGS. 1 to 3, the drive pulley 55 for the endless belt 52 can be seen.

As can be seen especially from FIG. 1, the rolling surface 56 of the rail 26 as well as the rolling surfaces of the other rails 21 to 25 of the ring spinning frames 11 to 14 are at the same height as the rolling surface of the track 42 of the suspension carriage 43. It is therefore possible to run the servicing device 32 for changing coils, for instance, onto the rails 23 and 24 of the ring spinning frame 13, as shown in FIG. 3. To this end, the servicing device 32 is first run on the transverse track 36 by means of the endless belt 52 in such a manner that it is in readiness at the machine end 19 of the ring spinning frame 13.

At the ring spinning frame 13 is seen, according to FIG. 1, among other things, a multiplicity of individual spindles 57, on which not quite full coils or cops 58 are wound. Supply coils 60 which serve for supplying the individual units (not shown in detail) with roving are suspended from a frame structure 59. Details of the servicing device 30 for the spinning operation can also be seen in FIG. 1. This servicing device also has the shape of a portal. In detail are seen a servicing unit 61, a cleaning unit 62 and a propulsion drive 78 having a propulsion motor 63, a running mechanism 79 and a switch 80 for reversing the direction of the propulsion motor.

At the machine end 19 is seen an automatic spinning control 64 which controls the spinning operations of all spinning units of the machine. A timer 65 is connected to the automatic spinning control 64 by a cable 66. A further cable 67 leads to the servicing device 30 for the spinning operation. Electric wires lead to several devices which are connected to the rails 27 and 28. The function of these devices will be described in further detail hereinafter. A line 69 leads to an interlock switch 70 and from there, a line 71 goes to the motor 51. The rail 16 serves for supporting the servicing devices during travel and while they are active.

Figure 6:
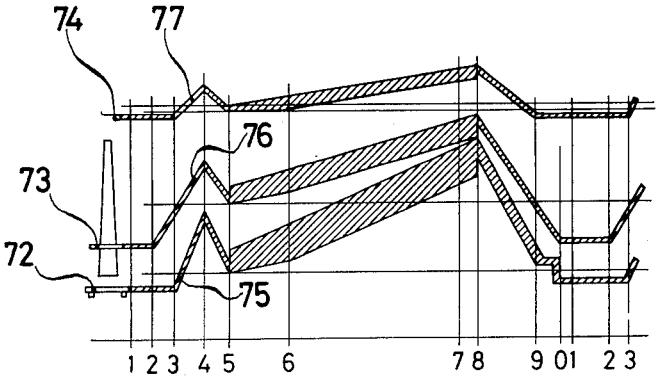
FIG. 6 is an operating diagram of the automatic spinning control of the ring spinning frame.

In the control diagram according to FIG. 6, the control curve for the ring bank 72 is designated with reference numeral 75, the control curve for the ring separator 73 with reference numeral 76 and the control curve for the thread guide 74 with reference numeral 77. The control times characteristic for the control of the spinning processes of all spinning units of the machine are designated with the reference numerals 1 to 0. The same numerals are also carried by the timer 65. It should be noted that the time scale between the times 6 and 7 is shown compressed.

Further details are seen from the description of the operation which follows:

It is seen from FIG. 1 that the pointer 81 of the timer 65 has reached the time mark 7. It can be seen from the control diagram of FIG. 6 that at the time mark 7, the spinning process is not yet fully completed. Since, however, the servicing device 30 as well as the servicing device 32 are to be in readiness at the machine end 19 of the ring spinning frame 13 at the time when the spinning process is completed, the automatic spinning control 64 already gives the control commands required therefor at the time 7. This involves the following individual actions:

Through the further cable 67 and the line 82, the propulsion motor 63 of the servicing device 30 for the spinning operation is switched to high speed. Simultaneously, the electromagnetic drive 84 connected to the line 83 pulls back the latch 85. In FIG. 1, the latch 85 is still extended. In the normal operation of the servicing device 30, the latch 85 serves to reverse the direction of rotation of the propulsion motor 63 by means of the switch 80. The motor 51 receives an "on" command over the line 69, the interlock switch 70 and the line 71. Since it is assumed that the other ring spinning frames 11, 12 and 14 have by far not reached the end of the spinning time, the interlock switch 70 is not blocked, so that the motor 51 can start. Simultaneously, an "on" command also goes to the electromagnetic drive 86 over the line 68 so that thereupon the bridge 87 is swung from the position shown in FIG. 1 into the position shown in FIG. 2. In this process, a slider 88 which had previously closed a gap in the rail 28, is pulled out.

While the servicing device 32, pulled by the endless belt 52, now approaches the machine end 19 of the ring spinning frame 13, a latch 89, which is spring-loaded counterclockwise, slides on the rail 28 until it drops into the opened gap, as shown in FIG. 2. The servicing device 32 therefore comes to a standstill in front of the machine end 19, while the motor 51 is disengaged from the drive pulley 55 by means of a built-in slipper clutch.

If the servicing device 30 for the spinning operation approaches the machine end 19 before the servicing device 32 for changing coils has snapped in, the end switch 90 which is connected through a line 91 to the automatic spinning control 64 remains activated, the purpose of the end switch 90 is to switch off the propulsion motor 63 of the servicing device 30 through the automatic spinning control 64. The servicing device 30 then stops in standby position at the beginning of the machine end 19 until two indicators 92, 93, which are connected to the automatic spinning control 64 through a line 94, have indicated electro-optically that the servicing device 32 has snapped in in front of the machine end 19. If this has occurred, the end switch 90 is deactivated by the automatic spinning control 64, whereupon the propulsion motor 63 is switched on again and continues the servicing device 30 traveling in the direction of the arrow 95.

Finally, the servicing device 30 runs up quite closely to the servicing device 32, as is shown in FIG. 2. Then, hinged latches 96 engage automatically with pins 97, 98 of the servicing device 32 on each side of the servicing device 32. A projection 99 fastened to the servicing device 30 runs under the latch 100 and locks the servicing device 32 to the suspension carriage 43, and disengages the lock. Simultaneously, however, the switch 80 also runs against a fixed switching pin 101, whereupon the direction of rotation of the propulsion motor 63 is reversed and the servicing device 30 can be run together with the servicing device 32 against the direction of the arrow 95.

The servicing devices 30 and 32 are now ready for use for the purpose of changing coils. Taking the maximum travel times of the servicing devices into account, this case is no later than when the timer 65 is in the position 0, i.e. the spinning process completed. The automatic spinning control has caused the ring bank 72, the ring separator 73 and the thread guide 74 to have been run into the starting position, and gives a travel command to the propulsion motor 63. The thread guide 74 has reached its starting position at the time 9 but the ring separator 73 and the ring bank 72, only at the time 0. The coil changing operation now proceeds step by step progressing from one spindle to the next without intervention by the automatic spinning control 64.

When the jointly movable servicing devices have arrived at the right-hand end of the ring spinning frame 13, the coil changing process is also completed. At the right-hand end the direction of rotation is reversed again in a manner similar to the way it is done at the left-hand machine end by switching the switch 80, whereupon the servicing devices return at high speed to the machine end 19. As soon as the indicators 92 and 93 indicate the return of the servicing device 32 to the automatic spinning control 64, the latter causes the electromagnet drive 103 to be switched on over the cable 67 and the line 102. This results in the opening of the latches 96. In the subsequent return of the servicing device 30 against the direction of the arrow 95, the servicing device 32 for changing coils is left behind. After running over the end switch 90, the magnetic drive 84 is also deactivated again, so that the plunger 85 is extended for later causing the direction of the propulsion motor 63 to be reversed. Simultaneously, the automatic spinning control 64 causes an electromagnetic drive 104, which now retracts the latch 89, to be switched on over the line 105. Since the automatic spinning control 64 switches the electromagnetic drive 86 off again at the same time, the slider 88 again closes the gap in the rail 28.

While the automatic spinning control 64 now initiates a new spinning process with or without the aid of the servicing device 30, and the servicing device 30 thereupon runs back and forth alongside the ring spinning frame 13, the servicing device 32 can at first still stop in front of the machine end 19 until called upon by another ring spinning frame.

The ring spinning frames 11 and 12 have a common servicing device 29 for the spinning operation. It goes without saying that the two servicing devices 29 and 32 can be controlled by the automatic spinning control of the ring spinning frame 12 in such a manner that as far as possible, both of them are in readiness at the machine end 17 common to the ring spinning frames 11 and 12 at the time when the spinning process of the ring spinning frame 12 is completed. It must not be possible for the servicing device 29 to be called upon by the ring spinning frame 11, for instance, as long as a coil change which may have been initiated or is being executed at the ring spinning frame 12 is not completed and the servicing device 32 for changing coils has not arrived again at the transverse track 36. The conditions mentioned can be met by simple interlock devices.

There are claimed:

1. Method for preparing a ring spinning frame for automatic coil changing, which comprises issuing a command from a central automatic spinning control before the end of the spinning operation to at least one of a movable automatic servicing device for the spinning operation and a movable automatic servicing device for changing coils which has not yet reached the machine end of the ring spinning frame to move to the machine end, moving the at least one servicing device to the machine end, and connecting the servicing devices together at the machine end no later than the arrival of the at least one servicing device at the machine end, so that both mentioned servicing devices are placed in readiness at the machine end of the ring spinning frame when the spinning process is completed.

2. Method according to claim 1, which includes interlocking the control of both servicing devices when two or more ring spinning frames are operated in parallel and only one servicing device services two or more spinning frames, so that a coil change which is at least at the preparation stage in any spinning frame operated in parallel is completed before the automatic spinning control can control the servicing of another ring spinning machine.

3. Apparatus for preparing a ring spinning frame of a spinning machine for automatic coil changing, comprising a movable automatic servicing device for the spinning operation, a movable automatic servicing device for changing coils, central automatic means for controlling spinning at all spinning units of the machine, a machine end of the spinning frame, a timer connected to said central automatic controlling means being sequentially movable between at least a first time mark and a second subsequent time mark at which the spinning operation is ended, and means connected to said central automatic controlling means for initiating movement toward said machine end at said first time mark by at least one of said servicing devices which has not yet reached said machine end and for completing movement to the machine end substantially at said second time mark.

4. Apparatus according to claim 3 including a propulsion drive connected to said servicing device for the spinning operation, said propulsion drive being controllable by said central automatic spinning control means.

5. Apparatus according to claim 4, wherein said propulsion drive commonly drives both of said servicing devices.

6. Apparatus according to claim 4, wherein said servicing device for changing coils is couplable to said servicing device for the spinning operation.

7. Apparatus according to claim 4, wherein said servicing device for changing coils is couplable to said propulsion drive.

8. Apparatus according to claim 4, 5, 6, or 7, including a track disposed transverse to said ring spinning frame and above said spinning machine, said servicing device for changing coils being movable along said track from one ring spinning frame to another.

9. Apparatus according to claim 8, including a fixed other propulsion drive for moving said servicing device for changing coils along said track, said other propulsion drive being controllable by said central automatic control means of any spinning frame servicable by said servicing device for changing coils.

* * * * *